US005172458A

United States Patent [19]

Cooper

[11] Patent Number: 5,172,458

[45] Date of Patent: * Dec. 22, 1992

[54] METHOD AND APPARATUS FOR CREATING AN ARRAY OF WEFT YARNS IN MANUFACTURING AN OPEN SCRIM NON-WOVEN FABRIC

[75] Inventor: Paul Cooper, Royton, England

[73] Assignee: James Dewhurst Limited, Lancashire, United Kingdom

[ * ] Notice: The portion of the term of this patent subsequent to Mar. 31, 2009 has been disclaimed.

[21] Appl. No.: 758,941

[22] Filed: Sep. 9, 1991

Related U.S. Application Data

[63] Continuation of Ser. No. 469,432, Apr. 5, 1990.

[30] Foreign Application Priority Data

Oct. 7, 1987 [GB] United Kingdom ..... 8723574

[51] Int. Cl.[5] ..... D04H 3/04

[52] U.S. Cl. ..... 28/102; 66/84 A; 156/440

[58] Field of Search ..... 28/101, 102; 66/84 A; 156/440

[56] References Cited

U.S. PATENT DOCUMENTS

| | | | |
|---|---|---|---|
| 4.016,631 | 4/1977 | Cole | 28/101 |
| 4.030,168 | 6/1977 | Cole | 28/101 |
| 4.068,357 | 1/1978 | Goldsworthy et al. | 28/101 |

OTHER PUBLICATIONS

Knitting Times, vol. 41, No. 47, Nov. 13, 1972, pp. 85-103, Reisfeld, "Warp Knit Fabrics and Products-Part 2".

*Primary Examiner*—Werner H. Schroeder
*Assistant Examiner*—John J. Calvert
*Attorney, Agent, or Firm*—Richard E. Jenkins

[57] ABSTRACT

The invention relates to the production of non-woven fabrics in which an array of weft threads is created and then combined with a substrate, which may in itself comprise a set of warp threads. In the method according to the invention, the array of weft threads is formed by traversing a weft carrier which has a plurality of weft guides, across the weftspace between two sets of weft retainers. At the end of each traverse, the weft carrier is jogged (that is to say moved in the warpwise direction), so that at the next traverse, it lays a further set of weft yarns across the weftspace, and the weft yarns are hooked around the weft retainers. The jogging motion is such, that at each traverse of the weft carrier after the first traverse, some, but not all of the laid weft yarns are interdigitated with weft yarns previously laid by the weft carrier or another weft carrier, the remaining weft yarns laid at that traverse being spaced from each other to permit a further set of weft yarns to be interdigitated with them on a subsequent traverse of the or another weft carrier.

24 Claims, 12 Drawing Sheets

Figure 1:
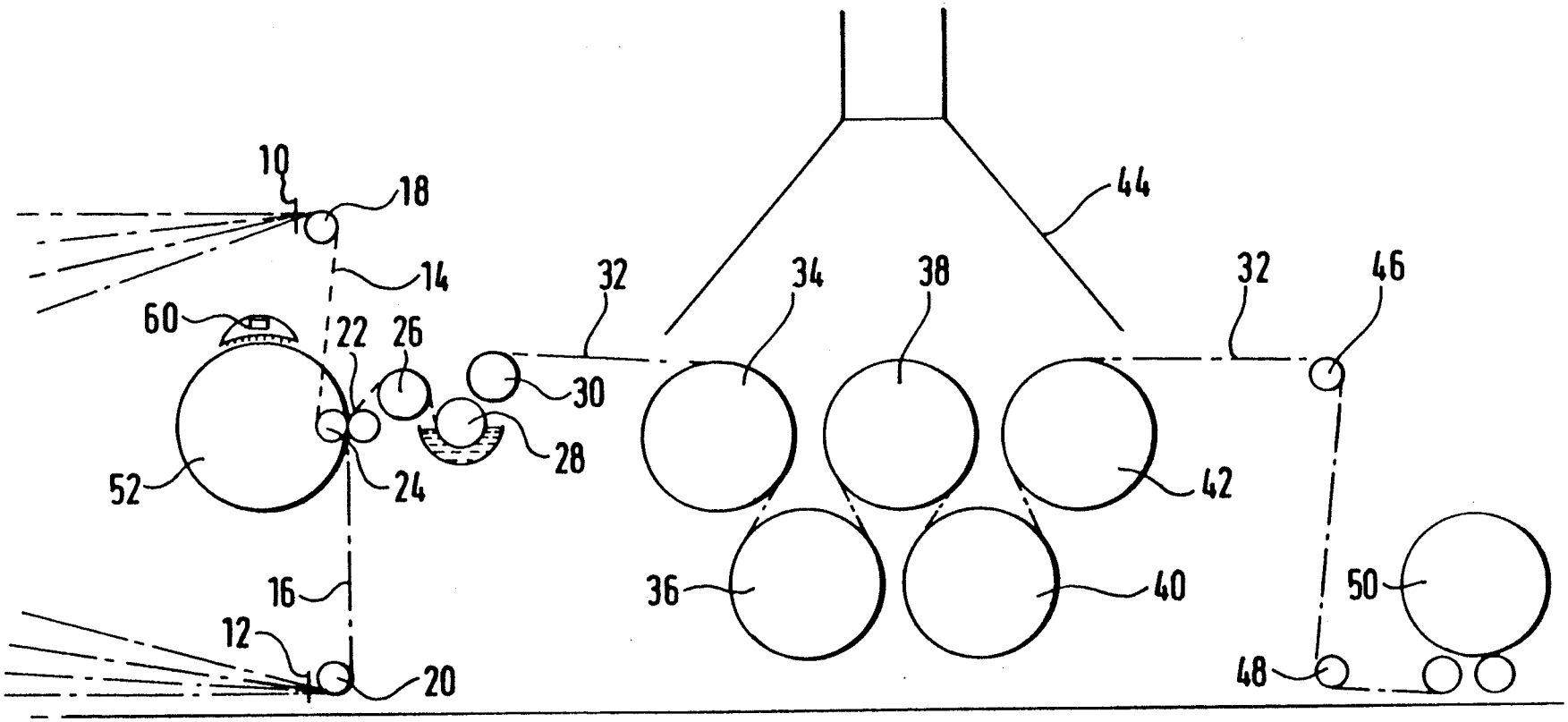

METHOD AND APPARATUS FOR CREATING AN ARRAY OF WEFT YARNS IN MANUFACTURING AN OPEN SCRIM NON-WOVEN FABRIC

This is a continuation of application Ser. No. 469,432, filed Apr. 5, 1990.

The present invention relates broadly to the production of non-woven fabrics employing weft thread that is to say threads extending across the width of the fabric. In a woven fabric, the weft threads are retained in warp threads by interlacing, that is to say, each weft thread passes successively under and over warp threads. In a non-woven fabric of the kind to which this invention primarily relates, the weft threads are not interlaced with warp threads but are simply laid across a longitudinal web or substrate there being a single substrate, in which case all weft threads are on one side of that substrate, or two substrates, in which case, the weft threads are sandwiched between the two substrates. It is to be understood however, that the invention in its broadest sense is not restricted to the formation of what are usually referred to as non-woven fabrics, since the invention provides a new method of producing any fabric wherein a weft array is formed and then combined with a substrate, and it might be used for example, in the manufacture of a knitted fabric in which the weft array is combined with a knitted substrate.

It is, of course, necessary to secure the weft threads to the substrate: the manner in which this is done is of no more than secondary importance in relation to the present invention; conventional techniques in the case where the substrate is a sheet of warp threads, include applying a chemical binder to the threads so that they adhere at the points where the weft threads cross the warp threads, or (in the case of synthetic threads) welding the weft threads to the warp threads by the application of heat or chemical solvent. In the case of application of heat or chemical solvent. In the case of a knitted substrate, the stitches of the substrate may be formed around the weft yarns.

Although by appropriate selection of the weft yarn, and the warp yarn where a warp is present, it is possible to make a wide variety of non-woven fabrics by the invention, it is particularly suitable for the manufacture of scrim material.

In theory, a manufacturing process which involves only laying the weft threads from side-to-side (i.e., selvedge to selvedge or weftwise) across a longitudinal web should enable much higher production rates to be achieved than is possible with a weaving process which involves shedding of the warp. However, some of the machines which have been developed to produce this kind of non-woven fabric are expensive and there are problems which restrict the practical operational speeds. Moreover, some of the known methods are very wasteful of weft yarn.

A primary object of the invention is to provide a method of manufacturing a fabric employing a weft yarn array which can operate at high production rates. It is a further object of the invention to provide a fabric producing machine which is adapted to operate at high production rates, and which is not itself very expensive. It is a still further object to minimize yarn wastage.

There are known methods of manufacturing fabrics in which a weft carrier laying a set of weft yarns reciprocates in a lateral (weftwise) direction across a weftspace between two sets of weft retainers and moves in a longitudinal (warpwise) direction relative to the weft retainers at one or both ends of its weftwise traverse to lay the set of weft yarns across the weftspace at each lateral traverse and hook each weft yarn around two non-successive weft retainers at each side of the weftspace.

The longitudinal relative movement between the weft carrier and the weft retainers can be obtained by moving the weft retainers in a forward direction, and in any case, they may be moving in this forward direction as part of the weft yarn array formation; but it is preferable to provide for jogging of the weft carrier relatively to the weft retainers at one or both ends of the carrier lateral traverse. In any event, the longitudinal movement has to be equal to the longitudinal distance occupied by the complete set of weft yarns on the carrier. However, this longitudinal movement creates waste weft yarn lengths at the selvedges, the waste increasing with the number of weft yarns on the carrier. At the same time, since there are practical mechanical limits on the speed of traverse and reciprocation of the weft carrier, the larger the number of weft yarns on the carrier, the greater the production rate. There is therefore a dilemma because for high production, one requires as large a number of weft yarns on the weft carrier as possible, but increasing the number of weft yarns on the carrier increases the yarn waste at the selvedges.

According to a first aspect of the invention in a method of manufacturing a fabric a weft carrier laying a set of weft yarns reciprocates in a lateral (weftwise) direction across a weftspace between two sets of weft retainers and moves in a longitudinal (warpwise) direction relatively to the weft retainers at one or both ends of its weftwise traverse to lay the set of weft yarns across the weftspace at each lateral traverse and hook each weft yarn around at least two weft retainers at one or both sides of the weftspace, in which the relative warpwise movement between the weft carrier and the weft retainers is such that at each traverse of the weft carrier (after the first traverse), some, but not all, of the laid weft yarns are interdigitated with weft yarns previously laid by the weft carrier or another weft carrier, the remaining weft yarns laid at that traverse being spaced from each other to permit a further set of weft yarns to be interdigitated with them on a subsequent traverse of the or another weft carrier.

The interdigitation of weft yarns laid in one traverse of a weft carrier with weft yarns laid on a previous traverse of that weft carrier to another weft carrier means that it is possible to produce a given weft yarn array with shorter longitudinal movements of the weft carrier(s) at the ends of a lateral traverse and consequently less yarn wastage at the selvedges. Alternatively, if a given yarn wastage is acceptable, then the number of weft yarns laid by the or each weft carrier can be increased thus increasing the production rate. In practice, an optimum production rate/yarn wastage can be obtained which is much higher than the optimum obtainable with the known method.

The method may be carried out in a way such that the number of weft yarns which is interdigitated with previously laid weft yarns at a traverse of the weft carrier is one less than the number of weft yarns which is laid spaced from each other. Alternatively, it may be carried out so that the number of weft yarns which is interdigitated with previously laid weft yarns is one greater than the number of weft yarns which is laid spaced from each other. In the preferred method however, at each traverse of the weft carrier (after the first traverse) the weft yarns which are interdigitated with previously laid weft yarns are so interdigitated with the spaced apart weft yarns laid on the immediately preceding traverse of the weft carrier, that a complete array of weft yarns is produced by the one weft carrier. Thus, in a specific example, the weft carrier is adapted to lay 27 weft yarns and during one lateral traverse it interdigitates 13 yarns with 14 yarn laid on a previous traverse and lays 14 yarn in a spaced apart condition ready for interdigitation by 13 yarn on the next lateral traverse.

According to one method of carrying out this aspect of the invention two weft carriers each laying a set of weft yarns each reciprocates in a lateral (weftwise) direction across a weftspace between two sets of weft retainers and moves in a longitudinal (warpwise) direction relatively to the weft retainers at one or both ends of its weftwise traverse to lay its set of weft yarns across the weftspace at each lateral traverse and hook each weft yarn around at least two weft retainers at one or both sides of the weftspace, so that the weft retainers retain the weft yarns at the selvedges the two weft carriers being 180° out of phase, so that they move in opposite directions when traversing the weftspace and the arrangement being such that at least some of the weft yarns laid by one carrier are at each traverse of that carrier (other than the first traverse) interdigitated with weft yarns previously laid by the other weft carrier. Since this particular method employs two weft carrier operating simultaneously, it is capable of particularly high production rates, and it is possible to interdigitate all the weft yarns laid by one weft carrier at each traverse with the weft yarns laid by the other weft carrier on its previous lateral traverse.

It will be appreciated that the amount of waste weft yarn at the selvedges is partly determined by the spacing between the weft retainers. This wastage is further reduced by a preferred method of manufacturing a fabric, in which there is a weft carrier laying a set of weft yarns in a lateral direction (weftwise) direction across a weftspace between two sets of weft retainers and moving in a longitudinal (warpwise) direction relatively to the weft retainers at one or both ends of this weftwise traverse to lay the set of weft yarns across the weftspace at each lateral traverse and hook each weft yarn around at least two weft retainers, the relative warpwise movement between the weft carrier and the weft retainers being such that during the formation of a weft array, each weft retainer is engaged on one of its leading and trailing sides by a weft yarn laid in one traverse of the or a weft carrier and on the other of its leading and trailing sides by a weft yarn laid in a subsequent traverse of the or a weft carrier.

Thus, each weft retainer takes part in the retention of two yarns, one laid in a left to right traverse and the other laid in a right to left traverse and this use of each weft retainer to retain two yarns enables twice as many weft yarns to be set up in an array on a given set of weft retainers as was possible in the known methods in which only weft yarn is hooked on to each weft retainer. This use of each weft retainer to hook two weft yarn can be applied to a method in which there is only a single weft carrier or to one in which there are two weft carriers, and in the latter case one of the weft yarns which engages with each weft retainer is laid by one weft carrier and the other by the other weft carrier.

Preferably, the weft retainers are provided on a pair of laterally spaced weft store devices each of which moves to cause its weft retainers to move in the longitudinal direction through a weft array-forming station where the weft carrier(s) lay the weft yarns across the weftspace.

According to the preferred feature of the invention, the weft yarns laid by the weft carrier or carriers are laid across one face of an advancing longitudinal web; the weft yarns are caused to adhere to the web and detached from the weft retainers so that the weft yarn array is then maintained by the longitudinal web.

Preferably the weft yarns laid by the weft carriers or carriers are laid between two advancing longitudinal webs which are pressed together to nip the array of weft yarns; the weft yarns held between the webs are then detached from the weft retainers and caused to adhere to the webs.

According to another method in accordance with the invention, two yarn arrays are produced by the method previously described, the two arrays being laid so that the weft yarns of one array are interdigitated in the longitudinal direction with the weft yarns of the other array.

Each longitudinal web may comprise a sheet of warp threads.

According to another preferred feature of this aspect of the invention, each weft yarn laid across the weftspace is severed from the remaining weft yarn at the selvedges.

According to another aspect of the invention a method of producing non-woven fabric having weft threads and wherein the weft threads are laid across an advancing longitudinal substrate, comprises the steps of paying out weft yarns from at least one weft carrier reciprocating from side to side between selvedges, to lay weft picks across the longitudinal substrate; retailing each weft pick at each selvedge by looping each weft yarn around a retaining member; removing the selvedge loops so that each weft pick is separated from adjacent weft picks and varying the pick spacing by varying the rate of advance of the longitudinal substrate relatively to the speed of reciprocation of the weft carrier. It will be appreciated, that it is of considerable advantage to be able to vary the spacing between the weft threads, particularly in the production of scrim-type fabrics. It is made possible, because of the method of forming the selvedge loops and removing them, so that each weft pick is independent of adjacent picks.

According to another aspect of the invention, a fabric producing machine comprises: a longitudinal substrate let-off and take-up mechanism; a weft store device adapted to move in the direction of travel of the longitudinal substrate; an arrangement for bringing an array of weft picks formed on the weft store into overlying contact with the longitudinal substrate, and a weft array forming mechanism which includes at least two weft carriers adapted to traverse the weftstore device in opposite reciprocatory motions between the selvedges in a manner such that at least some weft yarns laid by one carrier are at each traverse of that carrier interdigitated with weft yarns previously laid by the other weft carrier and means for retaining the weft yarns at the selvedges.

According to yet another aspect of the invention, a fabric producing machine comprises means for forming an array of weft yarns on a weft store in which there is a weft carrier mounted for lateral (weftwise) sliding motion on a beam and in which there is a cam operated mechanism for moving the beam, when the weft carrier is at the end of its lateral motion, in the warpwise direction.

Preferably, the weft store is circular, so that the warpwise direction is arcuate and the beam is mounted on a cam operated rocker adapted to turn about the axis of the weftstore.

Preferably, the weftcarrier reciprocation mechanism includes a mechanical multiplier. In one arrangement, the multiplier includes a pair of pulley-block devices coupled back-to-back and controlling movement of the weft carrier in respective opposite lateral directions.

According to another preferred feature of this aspect of the invention, the weft store comprises a pair of wheels mounted for rotation about an axis parallel with the direction of the weft picks (i.e., transverse of the warpwise direction), there being weft retainers projecting from the periphery of each of the wheels and the wheels being spaced apart laterally so that the two sets of weft retainers define the length of the weftspace.

According to a preferred feature of this aspect of the invention, a weft selvedge clamping means is provided in association with each weft store wheel. Such a clamping element may comprise an endless band carried by a pair of rollers spaced apart circumferentially of the weft store wheel in locations such that a tangent to the rollers forms a chord to the wheel and therefore the run of the endless band on the wheel-side of the rollers is deformed from the said tangent by the periphery of the wheel to ensure tight engagement of the endless band with the periphery of the wheel. Preferably the endless band is received in a groove in the periphery of the storewheel.

According to a still further preferred feature of the invention, a selvedge slitter cooperates with the periphery of each storewheel on the inside of the weftretainers so that it will sever the weft loops formed around the weft retainers from the weft picks in the fell of the fabric.

Figure 2:
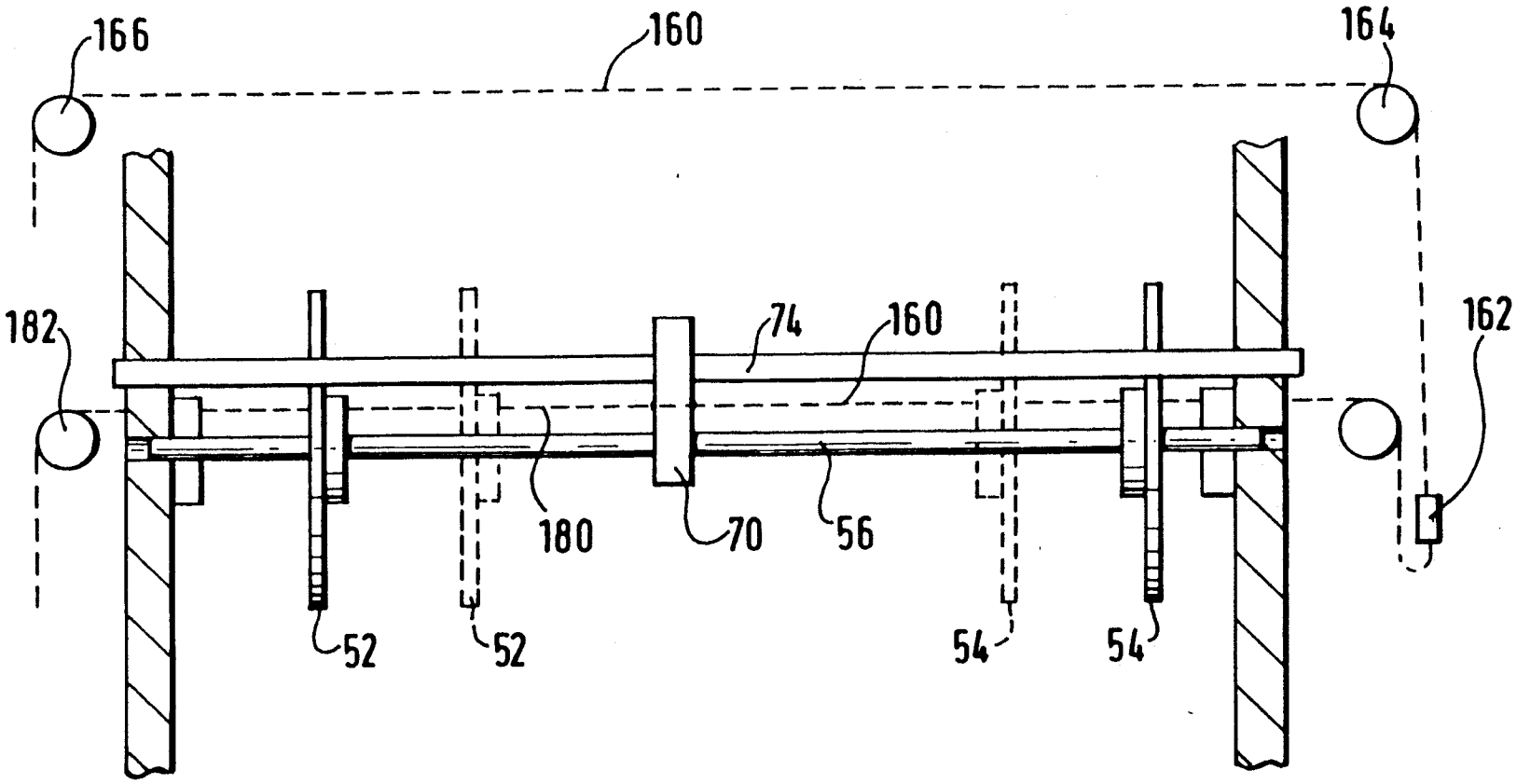
Figure 3:
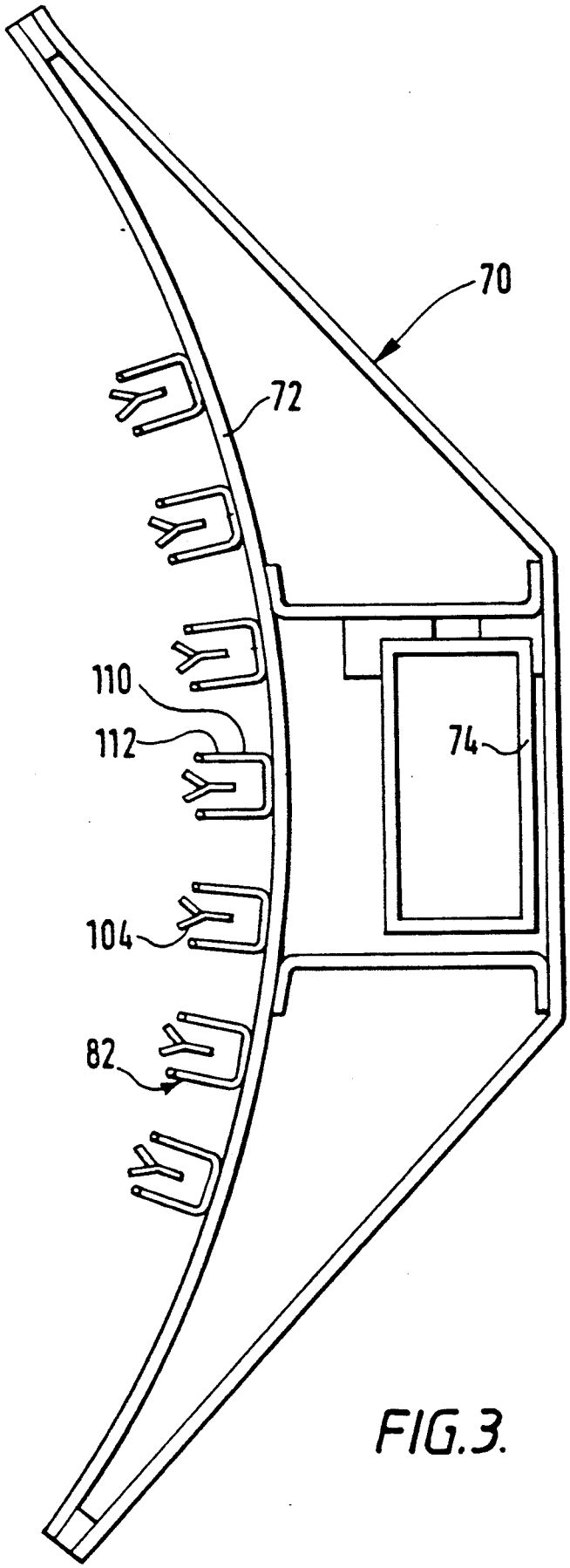
Figure 4:
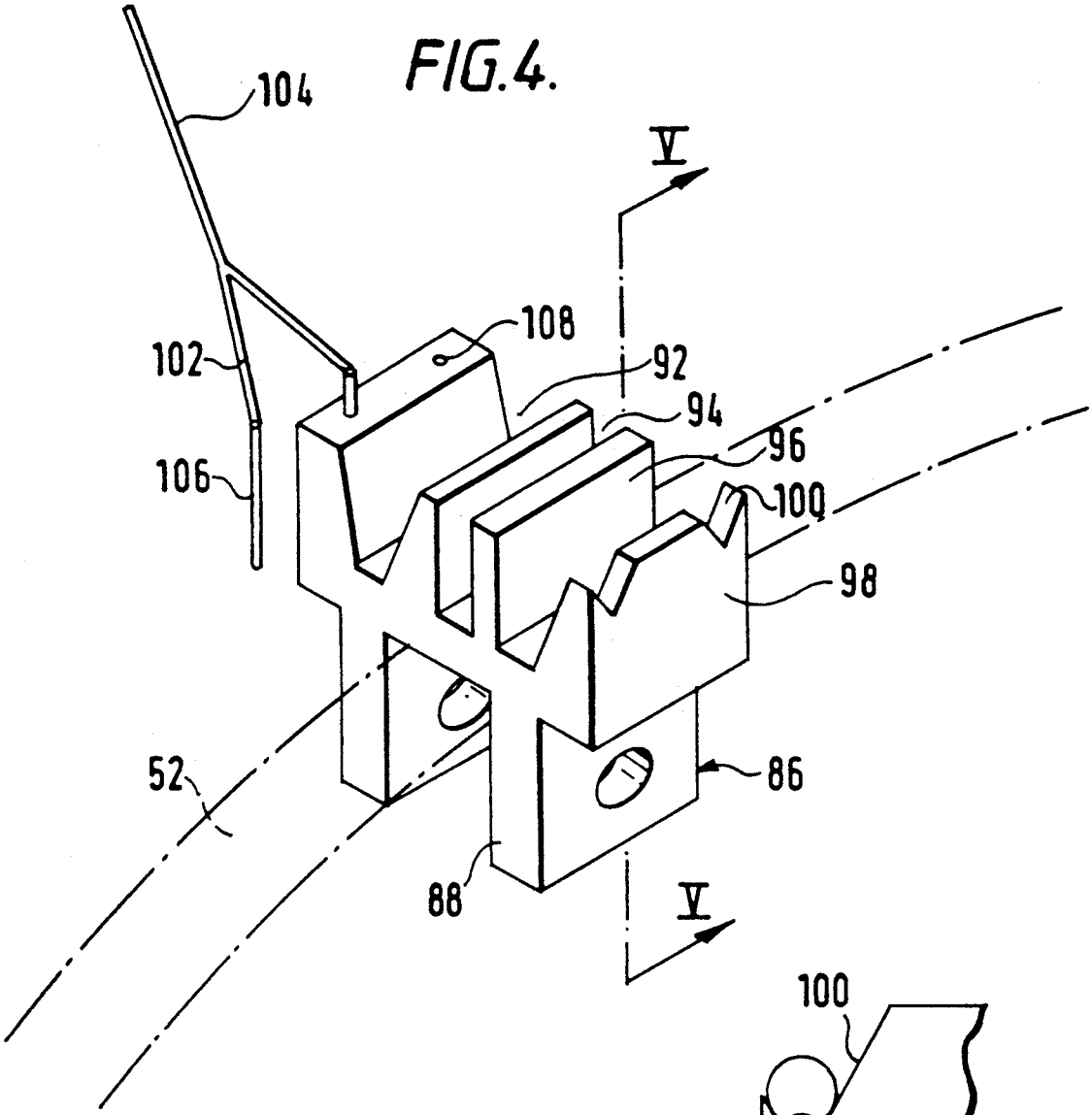
Figure 4A:
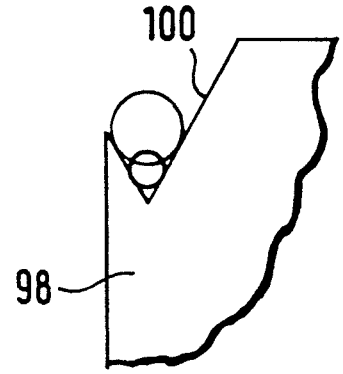
Figure 5:
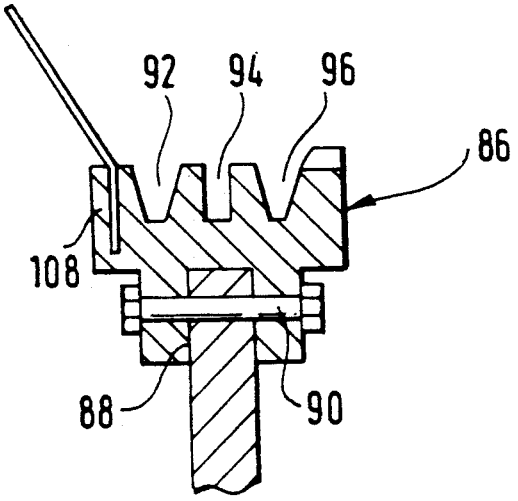
Figure 7:
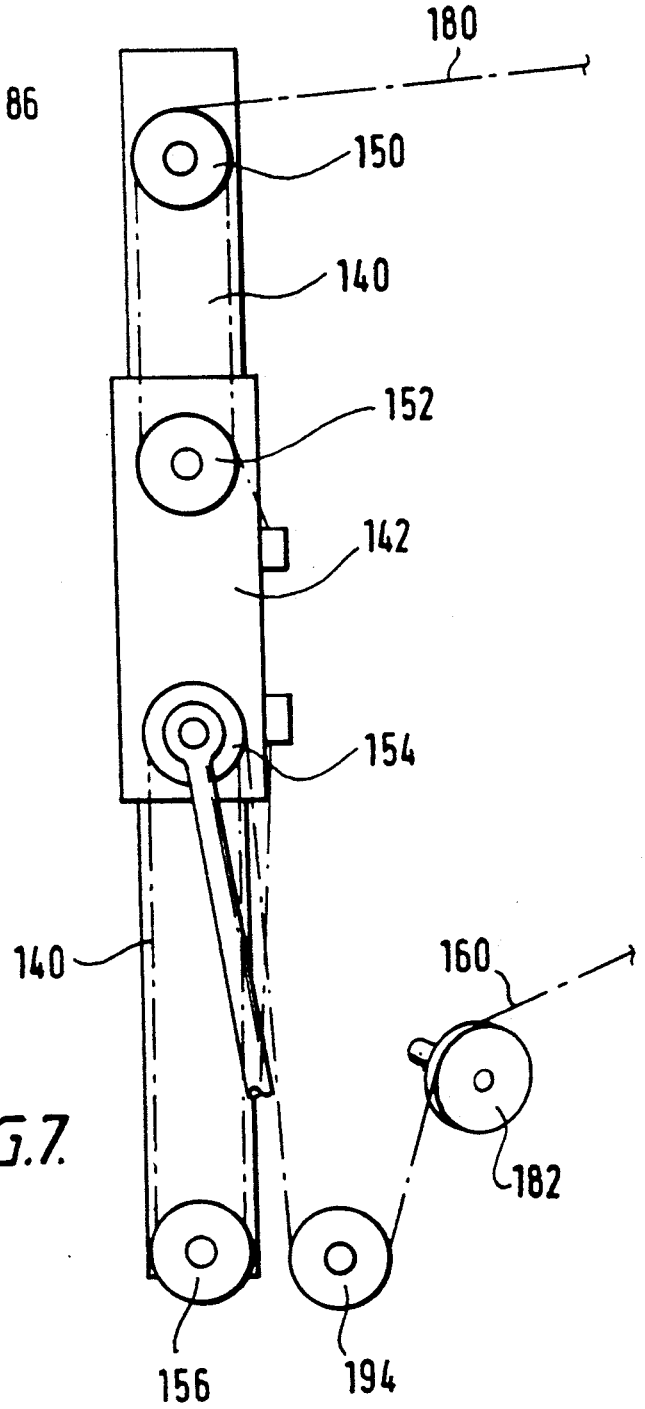
Figure 6:
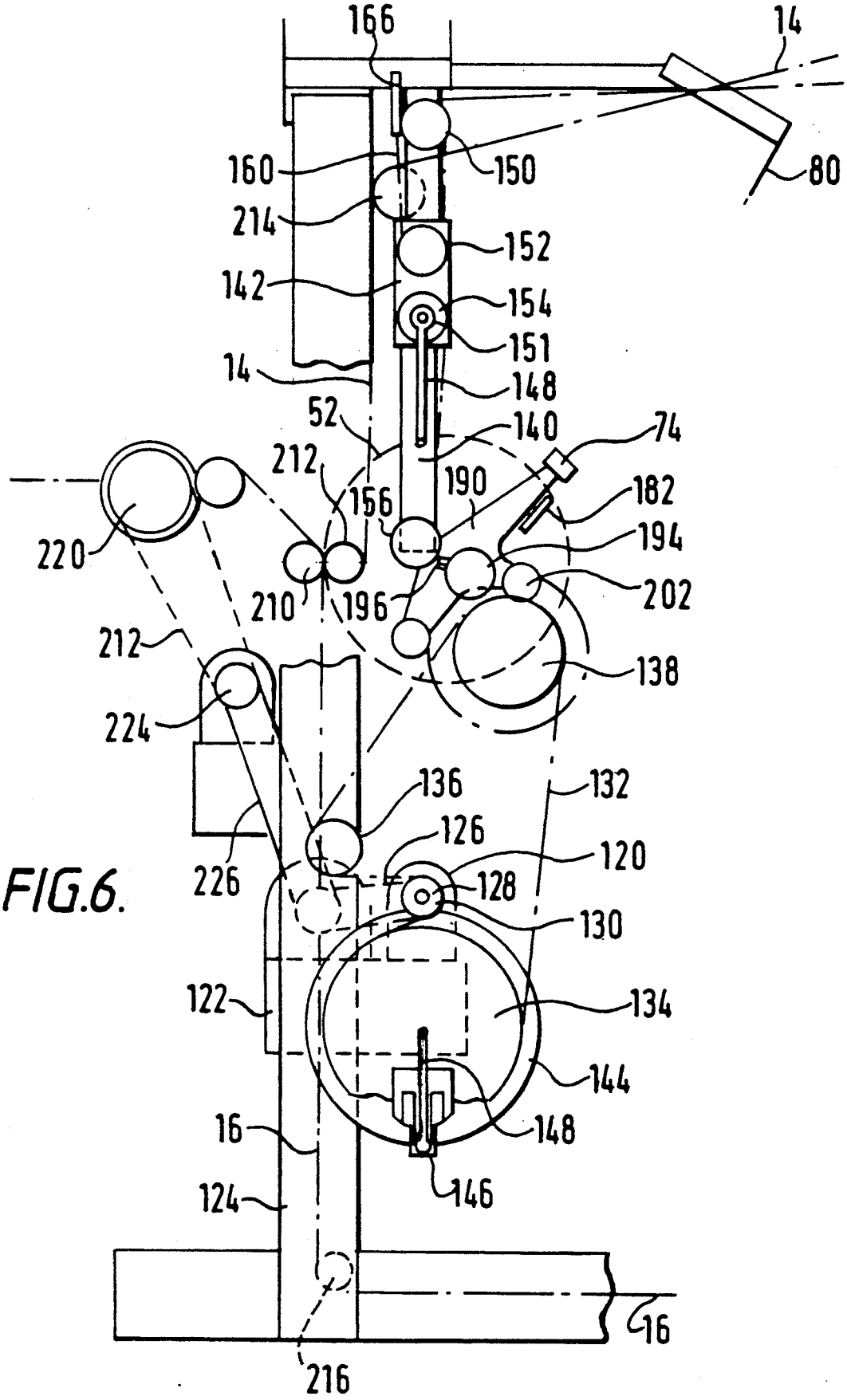
Figure 8:
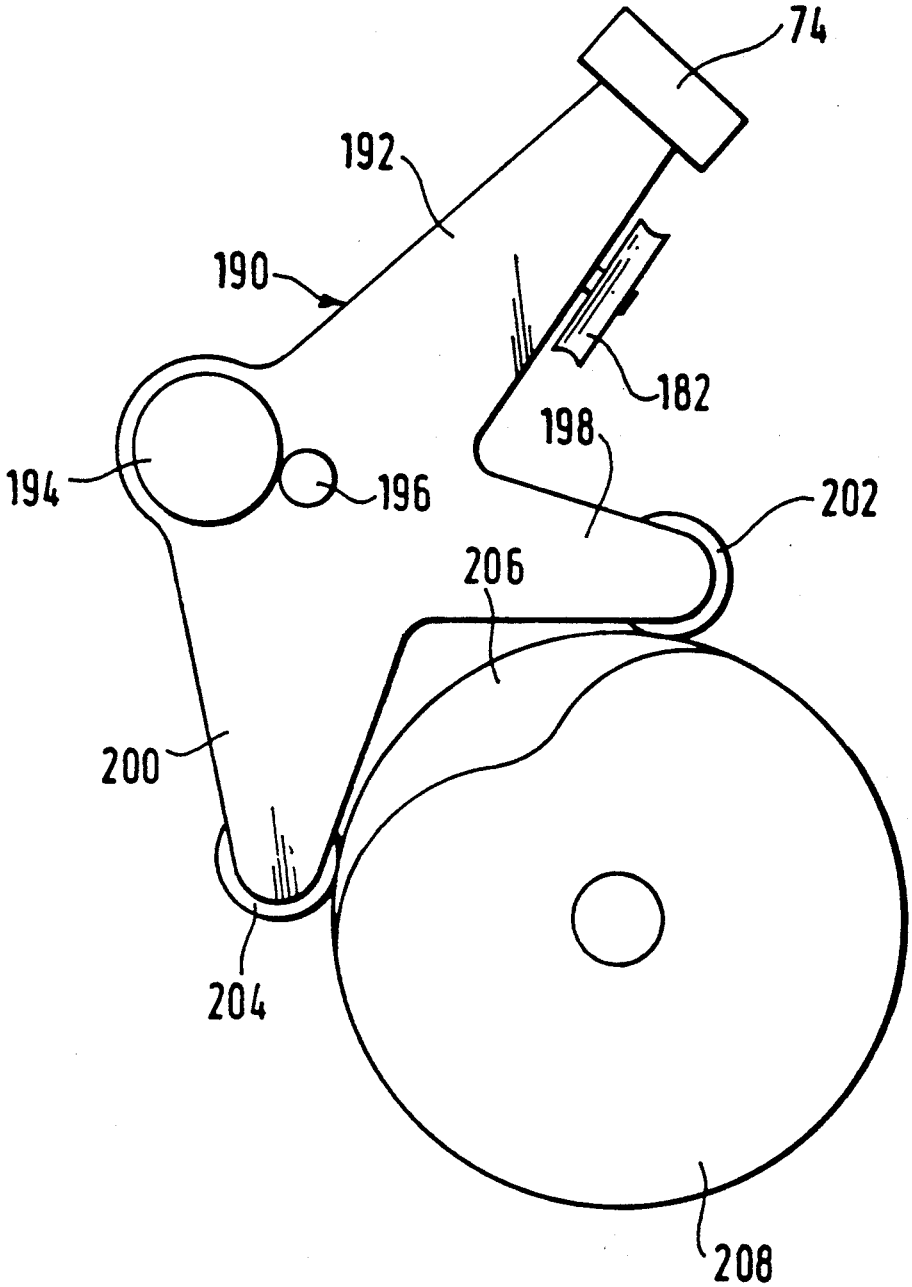
Figure 9:
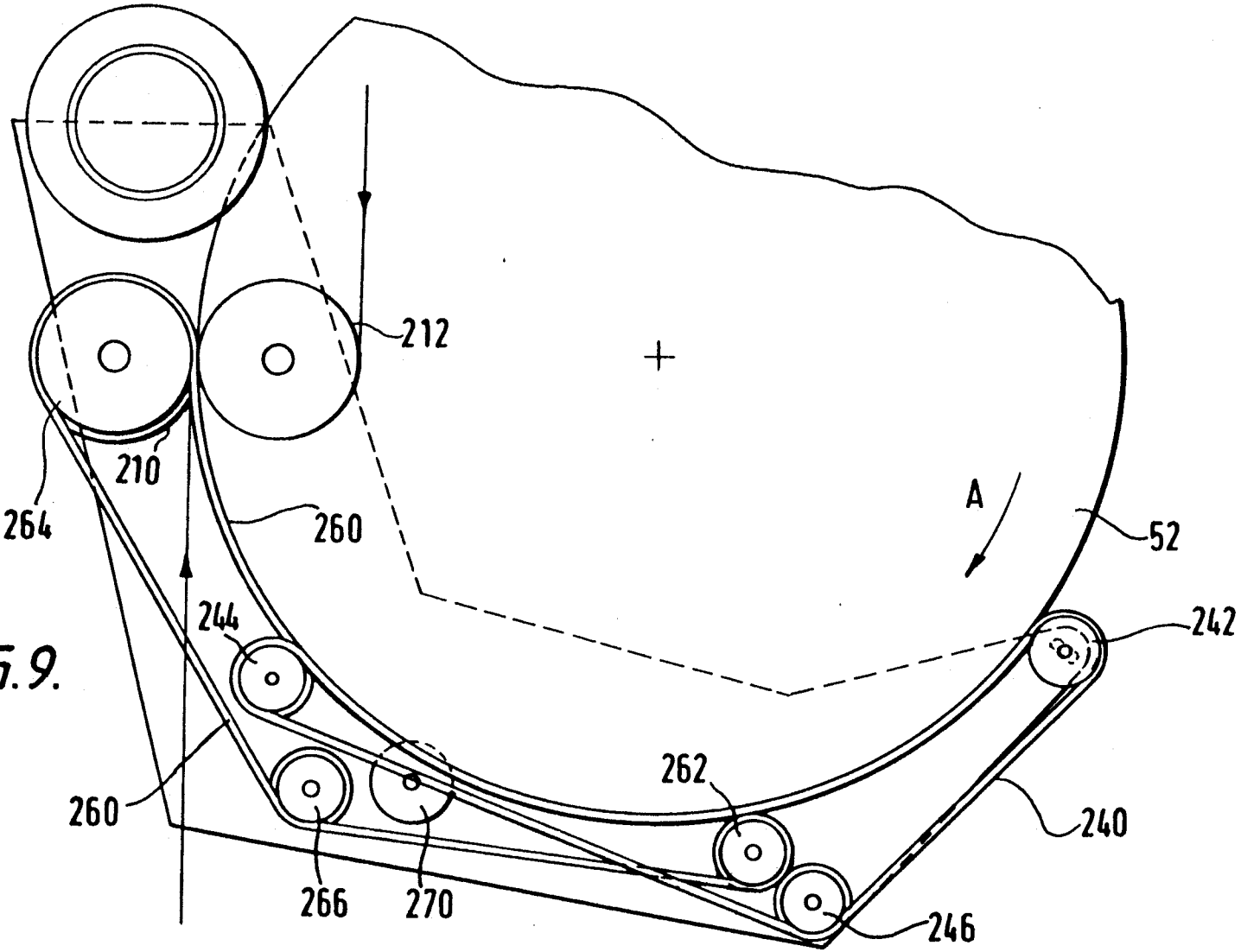
Figure 10:
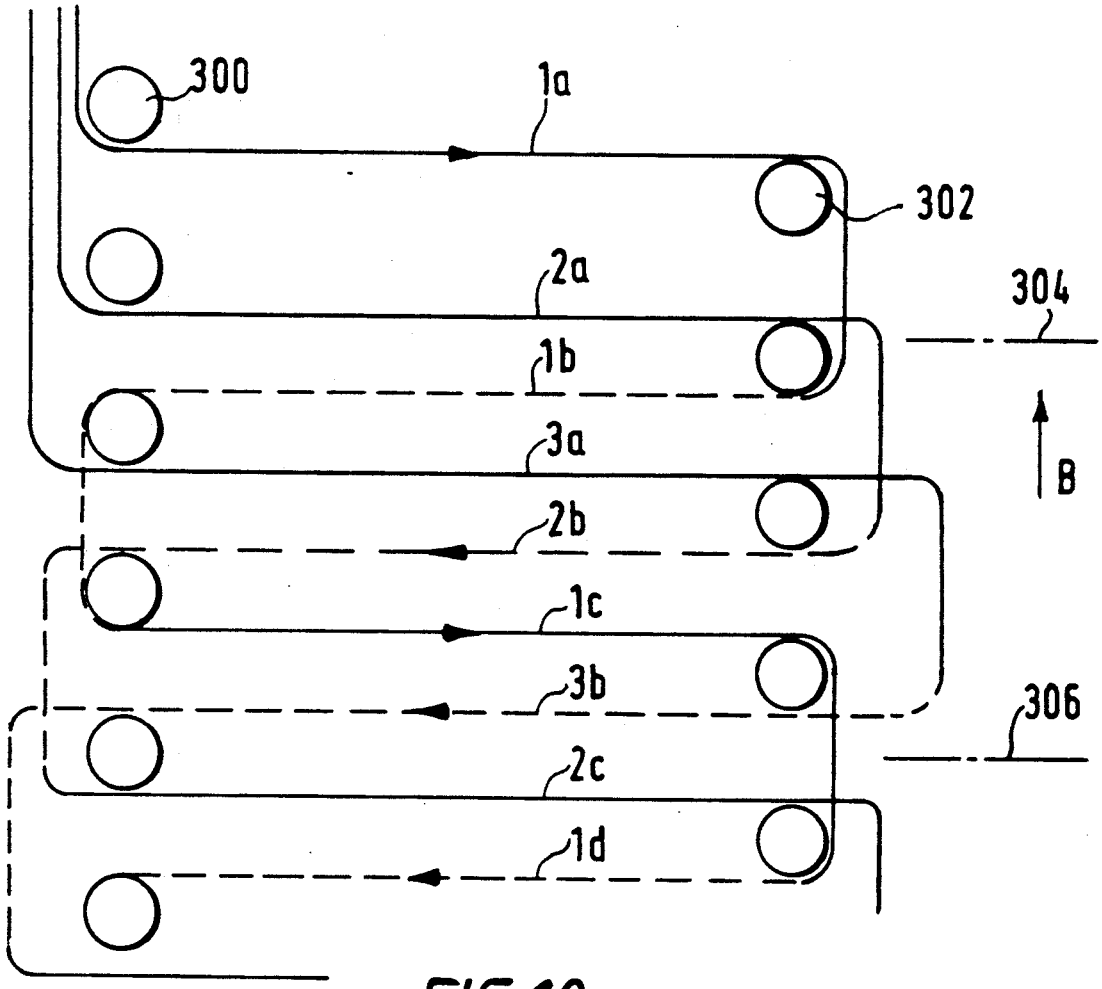
Figure 11:
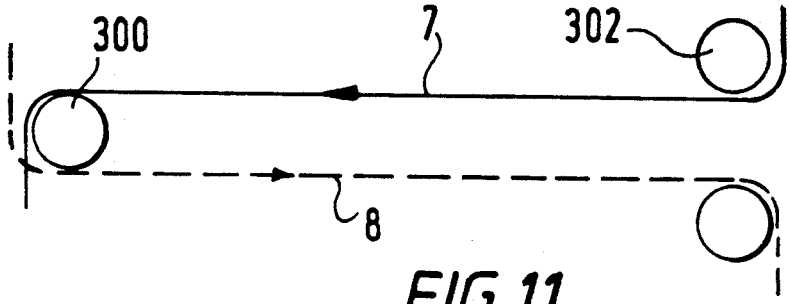
Figure 12:
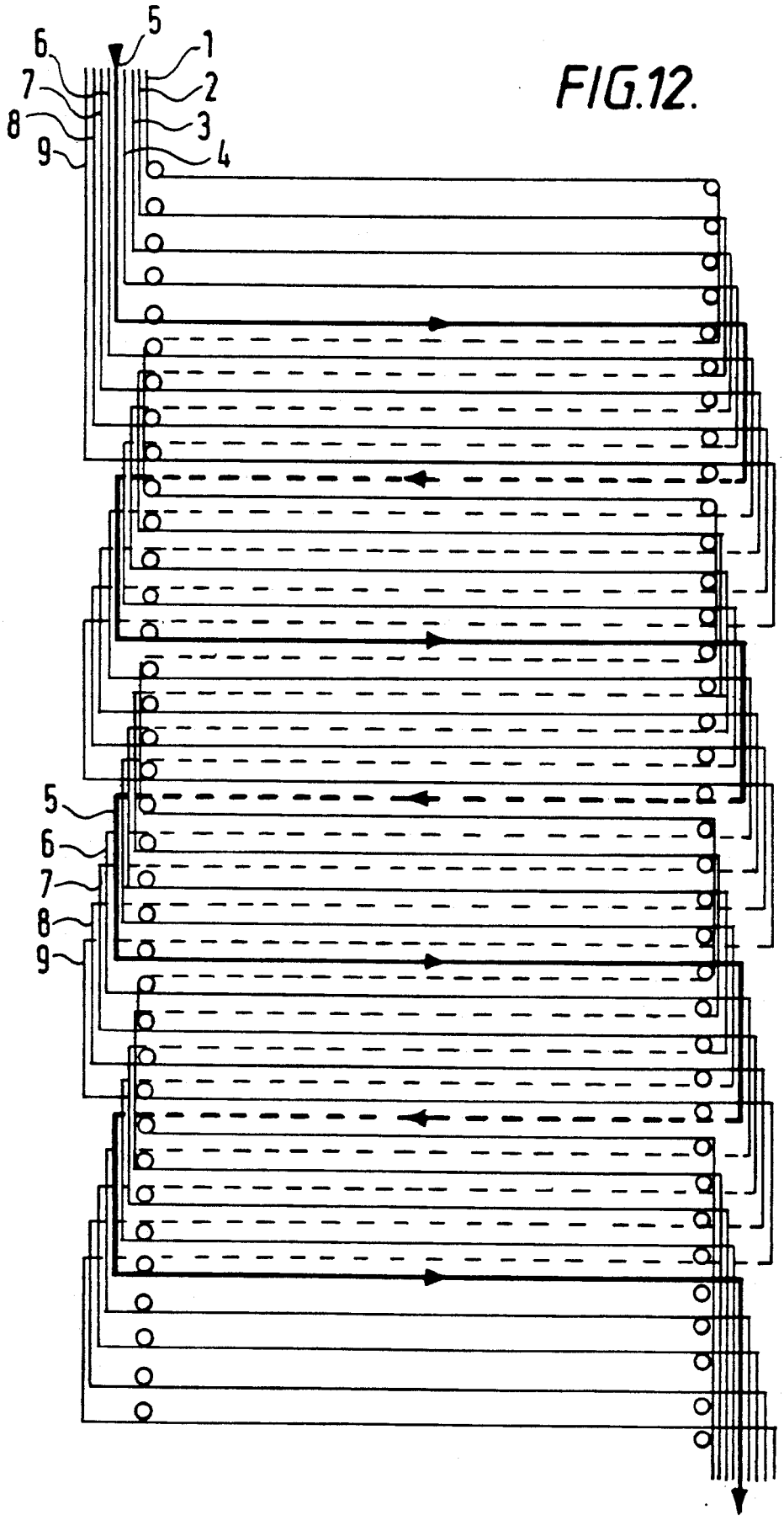
Figure 13:
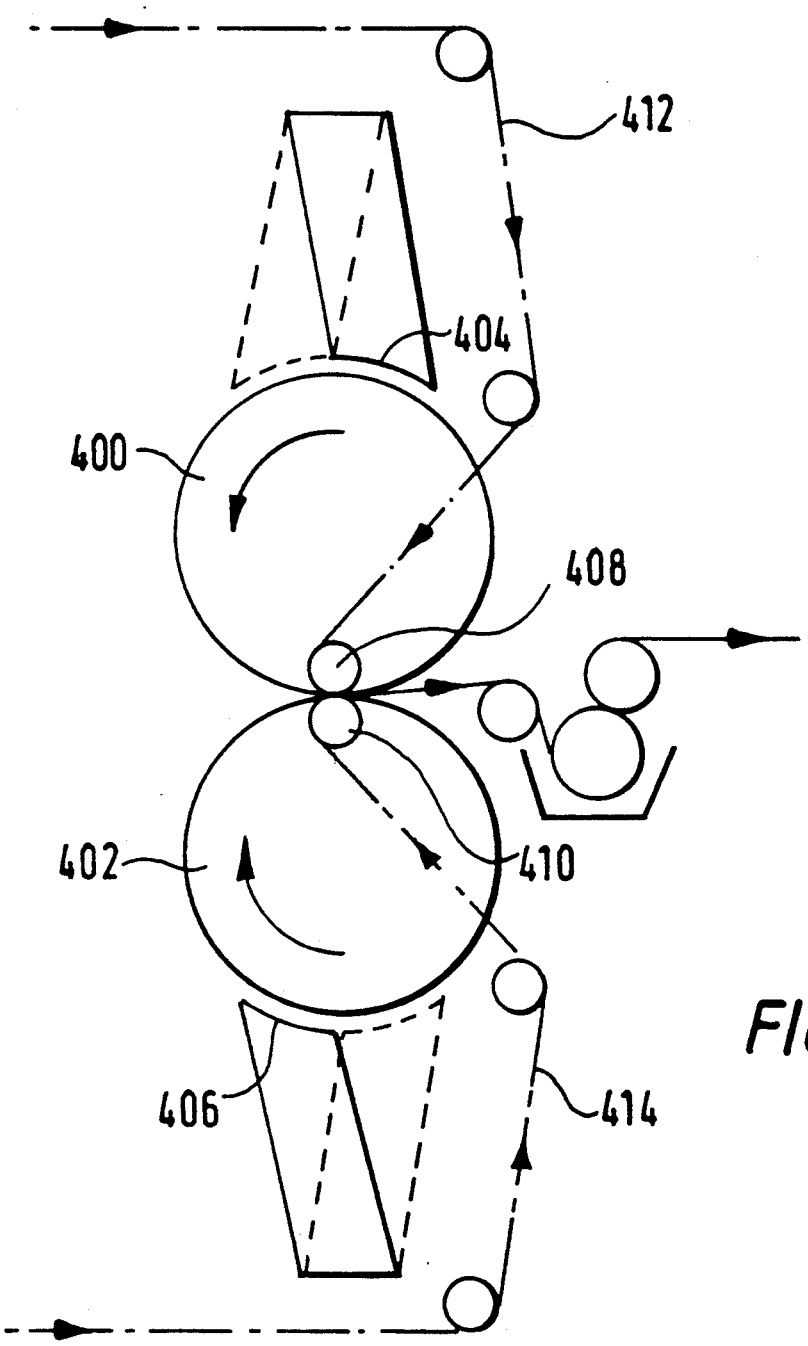
Figure 14:
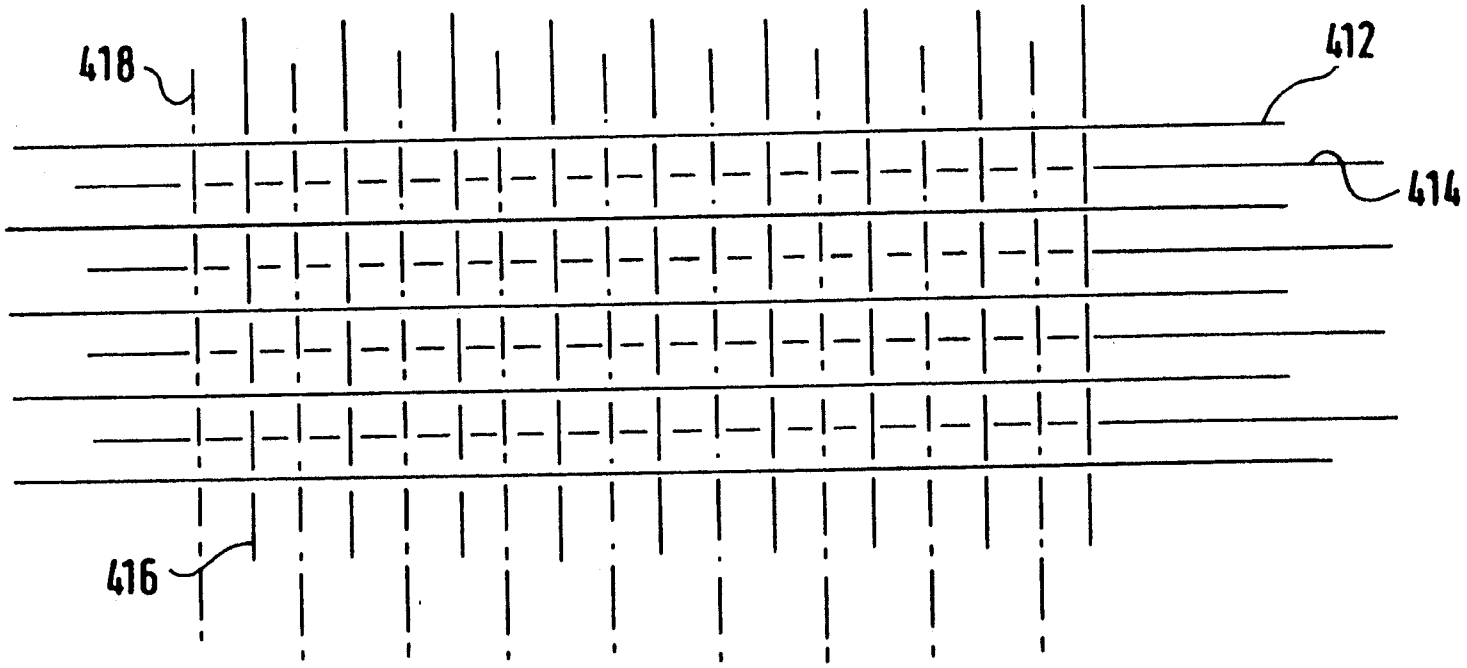

The invention will be more particularly described by way of examples only, with reference to the accompanying drawings, in which:

FIG. 1 is a diagrammatic side view of a fabric production machine showing the essential features of a fabric manufacturing process, FIG. 2 is a front view of a weft store forming part of a weft array-forming apparatus, FIG. 3 is an end view to a larger scale of part of the weft array-forming apparatus, showing a weft carrier, FIG. 4 is a perspective view of a weft retainer and weft groove arrangement forming part of the apparatus shown in FIGS. 2 and 3, FIG. 4A is a detail end view of a part of a toothed member, FIG. 5 is a section on the line V—V in FIG. 4, FIG. 6 is an end elevation of the weft array forming apparatus, FIG. 7 is a detail end view to a larger scale of a pulley block arrangement, FIG. 8 is a detail end view to a larger scale of a mechanism for jogging a weft carrier, FIG. 9 is an end view of a weft control arrangement at one side of the machine, FIG. 10 is a diagram illustrating the basic principle of weft array formation in accordance with the invention, FIG. 11 is a diagram showing the hooking of weft yarns around the weft retainers in accordance with the invention, FIG. 12 is a diagram showing a weft array formation using a weft carrier with nine weft yarn positions, FIG. 13 is a diagram similar to FIG. 1, but showing an alternative method of fabric manufacture, and FIG. 14 is a plan view of a scrim fabric produced on the machine shown in FIG. 13.

The apparatus which is illustrated in FIGS. 1 to 9 comprises a machine for the production of non-woven fabric of the kind having warp and weft threads, wherein the sheet of weft threads is simply laid across the sheet of warp threads without interlacing. In the particular fabric production method which is described hereinafter with reference to the drawings, the machine is being used to produce a scrim-type fabric, in which there are warpwise spaces between successive weft picks, and in which a single layer of weft picks is sandwiched between two warp sheets. The formation of this kind of scrim fabric is known per se.

Referring to FIG. 1, the warp threads from a creel (not shown) are drawn through upper and lower reeds 10 and 12, to form conventional top and bottom warp sheets 14 and 16. These warp sheets are drawn around guide rollers 18 and 20 and into the nip of a pair of feed rollers 22 and 24, at which position, the two warp sheets are brought together. From then on, the warp sheets travel together through the remainder of the machine, but at the nip between the rollers 22 and 24, a set of weft picks (not visible in FIG. 1) is incorporated between the two warp sheets as will be hereinafter described in detail. Hence, a composite fabric comprising two warp sheets and a set of weft picks travels from the nip rollers 22 and 24.

Beyond the nip rollers 22 and 24, the fabric travels over a guide roller 26, under a dip driven roller 28 in a bath of liquid adhesive, and then through the nip between the dip roller 28 and a squeeze roller 30. In passing under the roller 28 and over the roller 30, the composite fabric is coated with liquid adhesive.

The composite fabric 32 then passes over and under a series of drying rollers 34, 36, 38, 40 and 42, forming part of a drying unit, which includes a fume extraction arrangement 44. During the passage of the composite fabric through the drying unit, the adhesive cures, and relatively dry fabric 32 is drawn over and under guide rollers 46 and 48, to a take-up mechanism which incorporates a cloth roller 50. It will be appreciated, that the general layout of the machine which has been described above, is not new in itself. Furthermore, the details of the apparatus for impregnating the newly formed fabric with liquid adhesive and drying the coated fabric may be varied. Indeed, the newly formed fabric leaving the nip rollers 22 and 24 may be given a completely different treatment, such as a welding treatment, in order to secure the weft and warp yarns to each other. Essentially however, the present invention is concerned with the formation of a weft array and the presentation of that array to the two warp sheets. In FIG. 1, there is shown a weft store wheel arrangement 52, the periphery of which coincides with the nip between the rollers 22 and 24. In practice, the weft store which forms an important part of the invention comprises two such wheels 52 and 54 (see also FIG. 2) of the same diameter, keyed onto a driving shaft 56, which extends lengthwise of the machine, and is mounted in journal bearings in the machine frame. The shaft is driven so that the store wheels 52 and 54 turn continuously in a clockwise direction as seen in FIG. 1.

The weft store wheels 52 and 54 are mounted on keys or splines on the driving shaft 56, so that their lateral spacing can be adjusted. In practice, as will hereinafter appear, the lateral spacing between the weft store wheels 52 and 54 determines the width of the fabric which is produced on the machine and in fact, the fabric selvedges coincide with the store wheels 52 and 54 (which as will be apparent from FIG. 2, are relatively narrow). The space between the wheels 52 and 54 is referred to as the weftspace. A weft array formation and insertion unit 60 is provided in the region of the weft store wheels 52 and 54, in advance of the position at which the top and bottom warp sheets 14 and 16 are brought together by the nip rollers 22 and 24, for the purpose of laying an array of weft "picks" on the weft store wheels. This weft array formation and insertion unit as provided in a practical machine, will now be described in some detail.

The main element in the weft array unit 60 is a weft carrier 70 (see particularly FIG. 3) which is a fabricated aluminum element, having an arcuate inside face 72 concentric with the store wheels 52 and 54. The weft carrier 70 is slidably mounted on a box beam 74 which extends across the width of the machine adjacent to the weft store. The machine is provided with a weft creel (not shown) and in the particular machine shown in the drawings, the creel provides 27 weft yarns, but it will be understood that the machine can be designed to take a different number of weft yarns. As shown at 80 in FIG. 6, the machine has a weft yarn guide located at a high position centrally of the width of the machine, there being weft guide eyes, one for each weft yarn, at the yarn guide 80. The weft carrier 70 is provided with an equivalent number of weft yarn guides 82, as will be further described, on its arcuate face 72, and the weft carrier reciprocates laterally of the machine (i.e. weftwise) sliding on the box beam 74, and at each traverse, it pays out its weft yarns, laying them across the weftspace between the store wheels 52 and 54.

The effective periphery of each store wheel 52 and 54 is formed by a large number of tooth members 86 (see FIGS. 4 and 5). Each of these tooth members 86 is moulded in plastics material, though they could be formed in other materials. The inner part of each tooth member 86 is slotted at 88 to receive part of the periphery of the wheel 52 or 54 and a bolt 90 passing through the inner part of the tooth member and the wheel secures the tooth member 86 to the wheel.

Three grooves, 92, 94 and 96 are formed in the outer part of the tooth member 86, and the inner end wall 98 is formed with a pair of V notches 100 (see FIG. 4A). The tooth members 86 are secured to the wheel 52 or 54 all round its periphery and are quite close to each other. Therefore, the tooth members provide in effect three annular grooves around the periphery of the wheel, that is to say all the groove segments 92 provide an effective outer annular groove; all the middle groove segments 94 provide an effective middle annular groove and all the inner groove segments 96 provide an effective inner annular groove. The purpose of these grooves will become apparent later, but it will be understood that instead of providing the large number of tooth members 86, the annular grooves could be formed in the wheel itself, or in a flange or tire fitted to the wheel. The use of the tooth members enables the groove sizes to be changed by fitting a fresh set of tooth members, and also if part of the periphery of the wheel is damaged, it is only necessary to replace tooth members at the damaged part.

Each of the weft store wheels 52 and 54 is completed by a series of weft retainers 102. Each weft retainer is made of wire and comprises a central outwardly and upwardly inclined stem 104 and a pair of legs 106, the lower vertical limbs of which are pressed into holes formed in the outer end walls 108 of two adjacent tooth members 86—in other words, the legs of one weft retainer 102 bridge two tooth members 86 and a stem 104 lies between two adjacent tooth members.

The yarn guides 82 provided on the inside of the weft carrier 70 simply comprises ceramic eyes located in U-shaped brackets 110 bolted to the arcuate wall of the weft carrier. As is apparent in FIG. 3, the stems 104 of the weft retainers are aligned with the U-shaped brackets 110 and the circumferential spacing of the stems 104 and the brackets 110 is such that the brackets can pass the stems on the outward lateral traverse of the weft carrier 70 relatively to either of the weft store wheels 52 and 54—this circumferential spacing being illustrated in FIG. 3.

A weft yarn thread from the yarn guide 80 is taken through a respective eye in one of the brackets 110 on the weft carrier. If one end of the weft yarn is then secured to one of the weft store wheels 52 and 54, then, as the weft carrier reciprocates across the weftspace, the weft yarn is paid out by the weft carrier. At the opposite end of the weftspace, the weft carrier moves to an outer position where its weft eyes are on the outside of the stems 104 of the weft retainers on the weft store wheel. This is possible, because the arms of the brackets 110 can travel between the stems 104. Considering the weft eye 112 in FIG. 3, on an outward movement, it passes above the weft retainer stem 104. If the weft carrier then moves in a downward arcuate direction (concentric with the weft store wheels) to carry the weft eye 112 below the weft retainer stem 104 and then returns inwardly, the weft yarn paid out through the eye 112 is looped around the outside of the stem 104, which consequently retains the loop at the position of the store wheel (selvedge). This provides the means for holding the ends of the weft yarns laid by the weft carrier 70 at the weft store wheels 52 and 54 during the formation of the weft array.

It will be appreciated, that when a loop of weft yarn is formed around the outside of a stem 104, the inclination of that stem causes the loop to slide down the stem to its junction with the legs 106. The two weft yarn strands extending inwardly from the stem 104 therefore rest on the top edges of the tooth members 86. Thus, the weft yarn array is built up on the periphery of the two weft store wheels, that is to say the array of weft yarns is not flat, but conforms to the curvature of the store wheel peripheries (or more precisely, to the peripheries of the tooth members 86 on the store wheels). In practice, the weft carrier 70 moves, as will be explained, through a considerable angle relatively to the store wheels at each end of its lateral traverse, so that a particular weft yarn passing around the topside of one weft retainer stem 104 is looped around that stem and the stem of another retainer some distance below the first stem, there being a length of weft yarn extending on the outside of the two stems around which it is looped or hooked.

The mechanism for reciprocating the weft carrier 70 and for moving it in the arcuate direction (jogging) at the ends of its lateral motion are shown in FIGS. 6, 7 and 8.

An electric motor 120 coupled to a speed reduction gearbox, is supported on a bracket 122 which in turn is supported on the machine frame, an upright end stanchion 124 of which is shown in FIG. 6. A driving sprocket wheel 130 for a chain drive is keyed on the output shaft 128 of the sped reduction gearbox. This sprocket wheel 130 drives a chain 132 which passes around the following driven chain sprocket wheels, all of which are journalled on the machine frame:

- a relatively large crank wheel 134, the drive provided by the chain 132 being arranged to produce one complete revolution of this wheel 134 for each cycle of the machine (a cycle comprising reciprocation of the weft carrier 70, that is lateral movement across the weft-space and back again, with the jogging movements at each end of the lateral traverse):
- an idler wheel 136, and
- a cam wheel 138, the drive provided by the chain 132 being arranged to produce two complete revolutions of this wheel per cycle of the machine.

A stationary vertical slide 140 depends from the top part of the machine frame and a slide block 142 (see also FIG. 7) is mounted for vertical sliding motion from the slide 140. A crank wheel 144 coupled to rotate with the crank sprocket wheel 134 (i.e. once per cycle) carries a crank pin 146 and the lower end of a long connecting rod 148 is pivoted on the crank pin. The top end of the connecting rod 148 is pivoted at 151 to the lower end of the slider 142. Hence, as the crank wheel 144 rotates, the connecting rod 148 causes the slider 142 to reciprocate up and down on the slide 140 and there is one complete reciprocation per cycle of the machine.

A pulley arrangement is provided, including a top pulley block arrangement comprising two upper pulleys 150 journalled on the stanchion 124 and two lower pulleys 152 journalled on the slider 142. The pulley arrangement also includes a lower pulley block arrangement comprising two upper pulleys 154 on the slide block 142 and two lower pulleys 156 journalled on the stationary slide 140.

A plastics coated wire is employed to propel the weft carrier 70 across the weftspace, the wire being attached to the weft carrier 70. From the right-hand side of the weft carrier 70, as seen in FIG. 2, a top run 160 of this wire extends to the right-hand side of the machine, where it is guided around a set of idler pulleys 162 and 164. From the upper pulley 164, the wire 160 extends across the top of the machine and around an idler pulley 166 at the left-hand side (see also FIG. 6). The cord than extends down from the idler pulley 166, to the lower pulleys 152 and thence around the lower and upper pulleys 152 and 150 in typical pulley block fashion. Finally, the top run 160 of the wire is anchored to the slide block 142. Therefore, due to the pulley block arrangement, when the slide block 142 is being pulled downwardly by the crank 146, the top run 160 of the wire extending from the pulley block to the weft carrier 70 travels four times as far as the traverse of the slide block 142 and pulls the weft carrier towards the right-hand side.

The bottom run 180 of the wire extrudes from the left-hand side of the weft carrier 70; from there it extends to the left, over a direction changing pulley 182 (see FIGS. 2, 6 and 8) which is journalled on one arm 192 of a rocker 190 operation of which will be described later. It will be noted that the box section beam 74 on which the weft carrier 70 slides is carried by the arm 192, so that the direction changing pulley 182 rocks with the weft carrier. From the pulley 182, the bottom run 180 of the wire passes under a second direction changing idler pulley 194 also mounted on the rocker 190 but having its axis at 90° to that of the pulley 182 (see particularly FIG. 7), then up and over the top pulleys of the lower pulley block arrangement 154 and 156, around that arrangement and is finally anchored to the slide block 142. Therefore, when the slide block 142 is lifted by the connecting rod 148, it causes the bottom run 180 of the wire to pull the weft carrier 70 to the left through a distance four times the traverse of the slide block.

The arrangement of the crank, connecting rod, slide block and pulleys provides a mechanism for reciprocating the weft carrier 70. In effect, there are two pulley block arrangements, through the slide block takes part in both of these. The two pulley block arrangements simply provide a multiplier. When the weft carrier is being pulled to the right, by downward motion of the slide block, the bottom run of the wire is being paid out and conversely, when the weft carrier is being pulled to the left by upward movement of the slide block, the top run of the wire is being paid out.

The wire arrangement has been found to be very effective in providing rapid and smooth reciprocation of the weft carrier 70. By adjusting the radial position of the crank pin 146 on the crank wheel 144, the length of stroke of the cam and hence the length of lateral traverse of the weft carrier 70 can be varied. This lateral traverse will always be equidistant about a mid-position and is set so that the weft carrier 70 moves between any location just outside the setting of the store wheels 52 and 54 (FIG. 2) to enable the weft eyes carried by the weft carrier to move to the outside of the weft retainer stems 104 at each end of the traverse of the weft carrier.

Reverting now to FIG. 8 of the drawings, the rocker 190 is a three-armed lever and as has already been noted, its arm 192 carries the box beam 74 and a direction changing pulley 182. The rocker 190 is keyed on to a spindle which is coaxial with and extends through driving shaft 56 on which the weft store wheels 52 and 54 are keyed. Each of the other two arms 198 and 200 carries at its extremity a respective cam follower 202 and 204, these cam followers in turn engaging on the peripheries of respective cams 206 and 208 keyed on to a shaft on which the cam wheel 138 driven by the chain 132 is mounted. The two cams are an identical pair set 180° out of phase with each other, to produce rocking of the rocker 190 about its pivot 196 at two positions in the cycle of the machine. The arrangement is such that when the weft carrier 70 has arrived at one extremity of its movement (where its weft eyes are outside the weft retainer stems) the rocker is turned to carry the beam 74 and with it the weft carrier 70 through an arc about the axis of the weft store wheels. At the right-hand end of the machine, as seen in FIG. 2, another rocker identical with the rocker 190 is keyed on the spindle 196 and the right-hand end of the beam 74 is attached to this second rocker. Consequently the beam 74 is supported at both ends by the two rockers, but it is not necessary to provide cams at the right-hand end. Also the rocker at the right-hand end carrier pulleys identical with the pulleys 182 and 194 shown in FIG. 8 these constituting the pulley arrangement 162 indicating diagrammatically in FIG. 2. In other words the direction changing pulleys 182 and 194 are provided at both ends on respective rockers 190.

The rocking motion effects the jogging of the weft carrier and moves the weft eyes on the weft carrier rearwardly with respect to the forward motion of the weft retainers on the weft store wheels. The cam profiles are chosen to give the required angular jogging of the weft carrier and this must be an exact multiple of the pitch of the weft retainer stems 104 to ensure that each weft yarn is laid between two stems when the weft carrier returns on the next lateral traverse. At the end of that next lateral traverse, the cams cause the rocker 190 and its duplicate at the right-hand end, to return to its original position, so that the weft carrier moves angularly in a forward direction relatively to the weft store wheels. The jogging motion provided by the rocker and the cams 206 and 208 is important in the function of the weft array-forming method.

Gearing (not shown) between the shaft on which the cam wheel 138 is keyed and the driving shaft 56 causes the latter to be driven at a constant angular velocity, so that the number of weft "picks" passing a given point per unit of time remains constant. As will now be apparent, the weft array is initially built up on the weft store wheels, the weft yarns being stretched across the weftspace between the two store wheels and held at the selvedges around the weft retainers 104.

A pair of nip rollers 210 and 212 is provided (see also FIG. 9), each being freely rotatable about its own axis and the nip between these rollers coincides with the effective periphery of the weft store wheels formed by the tooth members 86. These nip rollers are the equivalent of the nip rollers 22 and 24 shown diagrammatically in FIG. 1. A top sheet of warp threads 14 is led from a creel (not shown) over a top guide roller 214 also freely rotatable about its own axis and supported by the machine frame, and then down under the nip roller 212 and up through the nip of the rollers 210 and 212. A bottom sheet of warp threads 16 is led from a creel (not shown) around a bottom guide roller 216, straight up into the nip of the rollers 210 and 212. This arrangement brings together the two warp sheets as described previously with reference to FIG. 1 and of course, if there are weft yarns travelling on the store wheels 52 and 54 around the underside of the store wheels from the position at which they are laid by the weft carrier 70, these weft yarns travel into the nip of the rollers 210 and 212 between the two warp sheets. The weft yarns therefore become trapped by the warp sheets at the nip rollers.

In FIG. 6 there is also illustrated a drawing off roller 220, driven by a chain drive 222 from a variable ratio gearbox 224 which itself is driven by belt drives 226 and 126 from the geared motor 120. The combined warp sheets and the weft array nipped between them are pulled forwardly for subsequent processing by the roller 220. It will be appreciated that because of the constant speed of rotation of the weft store wheels, the weft threads are supplied from the machine at a constant number of "picks" per minute. However, the surface speed of the drawing off roller 220 can be varied by adjusting the variable ratio gearbox 224 and hence the rate of feed of the warp sheets can be varied. The result of varying the speed of forward travel of the warp sheets whilst at the same time maintaining a constant number of "picks" per minute of the weft threads is to vary the spacing between the weft threads in the finished fabric. This is a useful facility, especially when making a scrim.

It will be observed that the weft array has to travel through a considerable arc around the underside of the weft store wheels between the position at which the array is formed by the interaction of the weft carrier 70 and the store wheel weft retainers 104 on the one hand and the position at which the weft yarns are gripped by the two weft sheets 14 and 16 on the other hand. Initially, the weft yarns are held in place by the stems 104 of the weft retainers. However, the loops at the ends of the weft yarns have to be cut off so that each weft "pick" is separated from the others, to permit the relative motion between the warp sheets and the weft array to enable the variable spacing between the weft yarns. Consequently, it is necessary to provide means for securing the weft yarns and holding the yarns on the store wheels until they are gripped by the warp sheets.

Referring now to FIG. 9, one of the weft store wheels 52 is illustrated, together with two sets of weft yarn gripping means. A weft cutter disc 270 is located on the machine frame at a position below the weft store wheel 52, and this cutter wheel extends into the effective annular groove formed by the groove segments 94—that is to say the central annular groove around the weft store wheel. The cutter disc 270 is quite thin, and has a diamond lapped edge. It is driven by a small pneumatic motor not shown, so that it rotates at very high speed. A rubber or rubber-like circular cross-section belt 240 is guided around a set of three freely rotatable pulleys 242, 244 and 246 mounted on a support structure adjacent to the store wheel 52. The pulley 242 is located closely adjacent to the effective periphery of the wheel 52 at a position immediately beyond the lowest position of the weft carrier 70 in the direction of travel of the store wheel 52 (indicated by the arrow A). The pulley 244 is also located closely adjacent to the effective periphery of the store wheel 52, but at a position well beyond the pulley 242 and where the periphery of the wheel 52 is rising towards the nip rollers 210 and 212. The pulley 244 must be located beyond the position of the cutter disc 270 and beyond the furthest position to which the weft carrier can take any weft yarn on the jogging motion. The pulley 246 is simply a spacer pulley for the return run of the belt 240. Now it will be seen that the tangent to the pulleys 242 and 244 passes through the wheel 52, consequently, the inner run of the belt 240 is pressed towards the periphery of the wheel through the entire length between the two pulleys 242 and 244. In fact, this run of the belt sits in the effective annular groove formed by the outer grooves 92 in the tooth members 86, and consequently, any weft yarn extending across one of the tooth members 86 is pressed into the groove 92 and held tightly against the flanks of the V notch 100 in which it is located. FIG. 4A illustrates that weft yarns of different counts may be located in the V-grooves, which thereby provide accurate spacing of the weft yarns in the warpwise direction.

A second rubber or rubber-like circular cross-section belt 260 engages around three pulleys 262, 264 and 266, but whereas the belt 240 is aligned with the outer grooves 97 in the tooth members 86, the belt 260 is aligned with the inner groove 96 in those tooth members. It will be seen that the pulley 262 is located adjacent to the periphery of the store wheel 52 some distance beyond the pulley 242 in the direction of rotation of the wheel 52 but it is also located in advance of the cutter 270. The pulley 264 is coaxial with the nip roller 210, and the pulley 266 is simply a spacer pulley for the return run of the belt 260. It will also be observed, that the tangent between the pulleys 264 and 262 is inside the effective periphery of the wheel 52, and this means that the inside run of the belt 260 is pressed into engagement with the effective periphery of the wheel 52 around the complete arcuate path between the pulleys 262 and 264. In fact, the inner run of the belt 260 is pressed into the effective annular grooved formed by the segmental grooves 96 on the outsides of the tooth members 86.

If there is a weft yarn stretched across one of the tooth members 86, then it will also be pressed inwardly by the inner run of the belt 260 between the pulleys 262 and 264. Consequently, the weft yarn will be nipped on to the periphery of the weft store wheel 52 from the position of the pulley 262, to the nip of the rollers 210 and 212, where the two sheets of warp threads 14 and 16 take over the control of the weft threads.

Now assuming that a weft yarn is stretched across one of the tooth members 86 the yarn will be nipped by the inner run of the belt 240 once the yarn passes the pulley 242, that is to say almost immediately it has left the area of operation of the weft carrier 70. When the tooth member 86 passes the pulley 262, the weft yarn also becomes nipped by the inner run of the belt 260, and hence it is stretched taut across the middle groove 94. The cutter disc 270 engages with this tautly stretched portion of the weft yarn, and cuts through it, thereby severing the selvedge of the weft yarn from the "pick" of weft yarn which extends across the weftspace. When the tooth member 86 passes the pulley 244 the belt 240 releases the selvedge portion of the weft. However, the remaining portion of the weft which traverses the tooth member 86 is held on that tooth member by the belt 260, until the warp sheets 14 and 16 take over the control of the weft yarns at the nip of the rollers 210 and 212. Now the arrangement of the belts 240 and 260 and the cutter 270 is duplicated at the other side of the machine for the weft store wheel 54, so that there is provision for holding both ends of the weft "picks" and for severing the selvedges from these weft "picks" whereby each "pick" of weft yarn is separated from all the others.

A pneumatic waste yarn removal nozzle (not shown) is provided in the region where the selvedge yarns which have been cut off the "pick" yarns leave the control of the belt 240 for the purpose of removing these waste selvedge yarns to a collection position. Such pneumatic waste yarn removal systems are well known in relation to textile machines.

The basic principle of the method of forming a weft array on a machine of the kind just described, in accordance with the invention, is illustrated in FIGS. 10 and 11. In those figures, weft retainers are illustrated diagrammatically at 300 and 302. As has been explained above, the effective parts of the weft retainers are the inclined stems 104, but for present purposes, they are simply shown as pins, and there are two sets, one associated with each of the weft store wheels 52 and 54.

It is also assumed for present purposes, that the weft carrier 70 is adapted to lay only three weft yarns, 1, 2 and 3. In practice, it is highly unlikely, that the machine would ever be used to lay only three yarns from the weft carrier, but three yarns is the minimum number by which it is possible to illustrate the basic principle of the weft array-forming method.

On a first traverse of the weft carrier from left to right, the three weft yarns 1, 2 and 3, are each laid in the direction illustrated by the arrows, and in effect three weft "picks" 1*a*, 2*a* and 3*a* are formed. The weft store wheels are moving in the direction of the arrow B.

At the end of this first traverse of the weft carrier 70, the weft eyes on that carrier are outside the right-hand end of the weft retainer pins 302. The weft carrier is then jogged in the opposite direction to the direction of travel of the pins 300 and 302, i.e. downwardly as seen in FIG. 10. This jogging carries the weft eye associated with the weft yarn 1, to a position where it is below the weft retainer pin 302 immediately below the top pin, so that the return traverse of the weft carrier the weft yarn 1 is laid across the weftspace, as indicated by the dotted line 1*b*, forming another "pick". It will be seen that a loop is formed by the selvedge portion of the weft yarn around the top two pins 302 of the weft retainer pins at the right-hand side. Similarly, the weft yarn 2 forms a return "pick" 2*b*, and the weft yarn 3 forms a return "pick" 3*b*.

It is to be noted, that the weft "pick" 1*b* is interdigitated between the weft picks 2*a* and 3*a* laid during the first traverse of the weft carrier from left to right, but that the weft "picks" 2*b* and 3*b* are simply spaced from each other, a sufficient width, to allow another weft "pick" 1*c* to be interdigitated between them, when the weft carrier 70 next moves to the right, to lay the weft "picks" 1*c*, 2*c* and 3*c*.

The full weft array-forming operation only commences with the second traverse of the weft carrier 70, because on the first traverse, the carrier lays two weft "picks" 1*a* and 2*a*, which are spaced apart double the spacing of the "picks" required in the finished array. However, if one considers what happens between the positions indicated by the lines 304 and 306, which is one half cycle of the machine, it will be seen, that on the return traverse of the weft carrier 70, it interdigitates one of its weft yarns 1*b*, with two weft "picks" 2*a* and 3*a* laid on the previous traverse, and at the same time, it lays two weft "picks" 2*b* and 3*b* spaced apart from each other, ready for the interdigitation of a further weft "pick" between then on a subsequent traverse of the weft carrier. Consequently, the weft carrier does not have to be jogged through a distance to bring the weft yarn 1 below the third pin 302 from the top, as would be the case if the weft carrier were not carrying out any interdigitation of the weft "picks".

A very important feature of this method is illustrated more particularly in FIG. 11. It will be seen that a weft yarn 7, drawn in full lines, is laid when the weft carrier moves from right to left, as indicated by the arrow on the weft yarn 7. Consequently, this weft yarn engages around the underside of one of the pins 302, and then around the top side of one of the pins 300. However, the next succeeding weft yarn 8 indicated in dotted lines, is laid when the weft carrier traverses from left to right, and consequently, that weft yarn engages around the underside of the retainer pin 302. Consequently, the pin 300 is engaged on its opposite side (i.e. leading the trailing side) by two successive weft "picks". This arises out of the interdigitation method used, and is a novel feature not found in previous weft array-forming methods.

It is not practicable to illustrate the weft array pattern formed by the specific embodiment described with reference to FIGS. 1 and 9 of the drawings, because there are so many weft threads involved. However, FIG. 12 illustrates what happens, when the system just described with reference to FIGS. 10 and 11, is used with nine weft yarns being laid by the weft carrier 70 at each traverse.

During the first traverse from left to right, all nine weft yarns are laid across the weftspace, the spacing between each adjacent pair of weft yarns being double that required in the finished array. The weft carrier 70 is then jogged downwardly (that is to say rearwardly with reference to the direction of motion of the weft store wheels) so that on the return motion, where the "picks" being laid are illustrated in dotted lines, each of the top four "picks" is interdigitated in one of the four spaces left between the bottom five "picks" laid on the first traverse from left to right. At the same time, the bottom five weft yarns are being formed into "picks" spaced apart by double the required spacing, thereby providing for interdigitation by four weft "picks" to be laid by the next motion of the weft carrier from left to right. This process is repeated, so that at each traverse of the weft carrier, some of the weft "picks" which are being formed are interdigitated with weft "picks" laid on the previous traverse of the weft carrier, and others are being laid spaced apart, ready for interdigitation by further weft "picks" to be made on the next succeeding traverse of the weft carrier.

In the machine which has been described, and the methods of operation which have also been described, there is a single weft carrier 70 which produces the entire weft array. However, it would be possible to construct a machine having two weft carriers similar to that illustrated at 70, the rockers 180 carrying the beams 74 being offset from each other circumferentially around the weft store wheels 52 and 54, so that the two weft carriers 70 are each able to perform the full reciprocation required to lay the weft yarns without striking each other. The mechanism illustrated in FIG. 6 is duplicated one set controlling the operation of one weft carrier 70 and the other controlling the other weft carrier.

With such an arrangement, during a first traverse of the first weft carrier, it lays its full set of weft "picks" but these are all spaced apart by twice the spacing required for the "picks" in the finished weft array. At the end of that first traverse, the first weft carrier is jogged rearwardly relatively to the motion of the weft store wheels, through the full distance occupied by all its set of weft "picks" and on its return traverse, it again lays a full set of weft "picks" spaced from each other by twice the spacing of the "picks" required in the finished array. When the second weft carrier makes its first traverse, it lays its full set of weft "picks", but these are interdigitated with the weft "picks" laid on the first traverse of the first weft carrier, and likewise, when the second weft carrier makes its return motion, it lays its full set of weft "picks" but these are interdigitated with weft "picks" laid by the first weft carrier on its return traverse. As in the arrangement illustrated in FIG. 11, each weft retainer is engaged on opposite sides by separate weft yarns, but with the two-carriers method one of these two weft yarns is laid by one weft carrier and the other weft yarn is laid by the other weft carrier. The advantage of this arrangement is simply that of high speed production, because there are two weft carriers operating simultaneously. It is preferable to arrange the two weft carriers to move simultaneously in opposite directions, in order to balance the forces applied to the machine frames.

FIG. 13 illustrates an alternative arrangement, and it is shown diagrammatically, in much the same way as FIG. 1. There are two weft store devices 400 and 402 mounted one above the other, and each of these weft store devices comprises a pair of weft store wheels, similar to the wheels 52 and 54, with all the associated driving equipment. In addition, there is a weft carrier 404 associated with the top weft store 400, and a bottom weft carrier 406 associated with the bottom weft store 402. It will be observed, that these weft carriers are adapted for jogging motion, as indicated by the dotted lines, the only difference from the arrangement illustrated in FIGS. 1 to 9, being that the weft carriers are mounted vertically above and below the two weft stores 400 and 402. Consequently, the two weft carriers are arranged to produce separate weft arrays on their respective weft stores 400 and 402. The direction of rotation of the weft stores is indicated by arrows.

The two weft stores meet each other at a central position, where there is a single pair of nip rollers 408 and 410. A top warp sheet 412 passes over guide rollers, and is then taken around the top nip roller 408, and similarly a bottom warp sheet 414 passes round guide rollers, and is then taken around the bottom nip roller 410. The two warp sheets are brought together where they pass through the nip rollers 408 and 410 as previously described, and then the combined fabric is taken through subsequent processing.

It will be appreciated however, that with the arrangement illustrated in FIG. 13, two separate weft arrays are brought into the nip between the rollers 408 and 410, and both weft arrays become sandwiched between warp sheets 412 and 414. As illustrated in FIG. 14 however, the weft "picks" 416 formed on the top weft store 400 which are illustrated in full lines, are interdigitated with the weft "picks" 418 formed on the bottom weft store 402, these weft "picks" being indicated in chain dotted lines. Consequently, it is possible to double the rate of production of this machine with respect to the machine illustrated in FIGS. 1 to 9.

In the specific embodiments described above, the longitudinal web or substrate takes the form of two sheets of warp threads. It is to be understood however that the methods and apparatus for forming the weft array could be used with other types of substrate. Moreover, the weft array-forming apparatus could be incorporated in a machine for the production of a substrate e.g. in a paper-making machine at a location such that the weft threads are incorporated in the paper stock before it has dried, so that the threads become bonded into the paper. Alternatively, and again by way of example only, the weft array apparatus could be combined with a needle punching machine to incorporate the weft threads in a batt of fibre before the punching operation. The invention has been found to be particularly useful for reinforcing fabrics.

I claim:

1. A method of manufacturing a fabric comprising: reciprocating a weft carrier laying a set of weft yarns in a lateral, weftwise, direction across a weftspace between two sets of weft retainers and moving said weft carrier in a longitudinal, warpwise, direction relatively to the weft retainers at at least one end of its weftspace traverse to lay the set of weft yarns across the weftspace at each lateral traverse, causing said weft carrier to hook each weft yarn around at least two weft retainers at at least one side of the weftspace, the relative warpwise movement between said weft carrier and said weft retainers being such that at each traverse of said weft carrier, after a first traverse, some, but not all, of the laid weft yarns are interdigitated with weft yarns previously laid by the weft carrier or another weft carrier, the reaming weft yarns laid at that traverse being spaced from each other to permit a further set of weft yarns to be interdigitated with them on a subsequent traverse of the or another weft carrier.

2. A method of manufacturing a fabric as claimed in claim 1 in which the weft yarns laid by the weft carrier or carriers are laid across one face of an advancing longitudinal web; the weft yarns are caused to adhere to the web and detach from the weft retainers so that the weft yarn array is then maintained by the longitudinal web.

3. A method of manufacturing a fabric as claimed in claim 2, in which two yarn arrays are produced, the two arrays being laid so that the weft yarns of one are interdigitated in the longitudinal direction with the weft yarns of the other array.

4. A method of manufacturing a fabric as claimed in claim 2, in which the longitudinal web comprises a sheet of warp threads.

5. A method of manufacturing a fabric comprising reciprocating two weft carriers each laying a set of weft yarns, in a lateral, weftwise, direction across a weftspace between two sets of weft retainers and further moving each weft carrier in a longitudinal, warpwise, direction relatively to the weft retainers at one or both ends of said weft carrier's weftwise traverse so that each of said two weft carriers lays said weft carrier's set of weft yarns across the weftspace at each lateral traverse and hooks each weft yarn around at least two weft retainers at at least one side of the weftspace, so that the weft retainers retain the weft yarns at the selvedges in which said two weft carriers are arranged 180° out of phase so that they move in opposite directions when traversing the weftspace and the arrangement is such that at least some of the weft yarns laid by one weft carrier are, at each traverse of that carrier, other than a first traverse, interdigitated with weft yarns previously laid by the other weft carrier.

6. A method of manufacturing a fabric as claimed in claim 5 further comprising moving said weft carriers in the warpwise direction through a distance such that during the formation of a weft array each weft retainer is engaged on one of said weft retainer's leading and trailing sides by a weft yarn laid by one of the weft carriers, and on the other of said weft retainer's leading and trailing sides by a weft yarn laid by the other weft carrier.

7. A method of manufacturing a fabric comprising: moving at least one weft carrier laying a set of weft yarns in a lateral direction across a weft space between two sets of weft retainers and moving said weft carrier in a longitudinal direction relative to the weft retainers at one or both ends of said weft carriers weftwise traverse to lay the set of weft yarns across the weft space at each lateral traverse and hook each weft yarn around at least two weft retainers, in which the relative warpwise movement between said at least one weft carrier and the weft retainers is such that during the formation of a weft array, each weft retainer is engaged on one of said weft retainers leading and trailing sides by a weft yarn laid in one traverse of a weft carrier and the other of said weft retainers leading and trailing sides by a weft yarn laid in subsequent traverse of a weft carrier.

8. A method of manufacturing a fabric comprising: reciprocating a weft carrier laying a set of weft yarns in a lateral, weftwise, direction across a weft space between two sets of weft retainers and moving said weft carrier in a longitudinal, warpwise, direction relatively to the weft retainers at at least one end of its weftspace traverse to lay the set of weft yarns across the weftspace at each lateral traverse, causing said weft carrier to hook each weft yarn around at least two weft retainers at at least one side of the weftspace, the relative warpwise movement between said weft carrier and said weft retainers being such that at each traverse of said weft carrier, after a first traverse, some, but not all, of the laid weft yarns are interdigitated with weft yarns previously laid by the weft carrier or another weft carrier, the remaining weft yarns laid at that traverse being spaced from each other to permit a further set of weft yarns to be interdigitated with them on a subsequent traverse of the or another weft carrier in which the relative warpwise movement between the weft carrier and the weft retainers is such that during the formation of a weft array each weft retainer is engaged on one of its leading and trailing sides by a weft yarn laid in one traverse of the or a weft carrier and on the other of its leading and trailing sides by a weft yarn laid in a subsequent traverse of the or a weft carrier.

9. A method of manufacturing a fabric comprising: reciprocating a weft carrier laying a set of weft yarns in a lateral, weftwise, direction across a weft space between two sets of weft retainers and moving said weft carrier in a longitudinal, warpwise, direction relatively to the weft retainers at at least one end of its weftspace traverse to lay the set of weft yarns across the weftspace at each lateral traverse, causing said weft carrier to hook each weft yarn around at least two weft retainers at at least one side of the weftspace, the relative warpwise movement between said weft carrier and said weft retainers being such that at each traverse of said weft carrier, after a first traverse, some, but not all, of the laid weft yarns are interdigitated with weft yarns previously laid by the weft carrier or another weft carrier, the remaining weft yarns laid at that traverse being spaced from each other to permit a further set of weft yarns to be interdigitated with them on a subsequent traverse of the or another weft carrier in which the weft retainers are provided on a pair of laterally spaced weft store devices, each of which moves to cause its weft retainers to move in the longitudinal direction through a weft array forming station, where the weft carrier(s) lay the weft yarns across the weft space.

10. A method of manufacturing a fabric as claimed in claim 9, in which the weft yarns are nipped between the weft store device and a clamping element moving in the same sense as the weft store device.

11. A method of manufacturing a fabric as claimed in claim 10, in which each weft yarn laid across the weftspace is severed from the remaining weft yarn at the selvedges.

12. A method of manufacturing a fabric as claimed in any one of claims 1 or 5, in which the spacing between adjacent weft yarns is varied by varying the rate of advance of the substrate relatively to the speed of reciprocation of the weft carrier(s).

13. A fabric producing machine comprising: a longitudinal substrate let-off and take-up mechanism; a weft store device movable in the direction of travel of the longitudinal substrate; an arrangement for bringing an array of weft picks formed on the weft store into overlying contact with the longitudinal substrate, and a weft array-forming mechanism which includes two weft carriers traversing the weft store device in opposite reciprocatory motions between selvedges in a manner such that at least some weft yarns laid by one carrier, are at each traverse of that carrier interdigitated with weft yarns previously laid by the other weft carrier, and means for retaining weft yarns at the selvedges.

14. A fabric producing machine as claimed in claim 13, in which there is a weft carrier reciprocation mechanism including a mechanical multiplier.

15. A fabric producing machine as claimed in claim 14, in which the multiplier includes a pair of pulley block devices coupled back-to-back and controlling movement of the weft carrier in respective opposite lateral directions.

16. A fabric producing machine as claimed in claim 13, in which the weft store comprises a pair of wheels mounted for rotation about an axis parallel with the direction of the weft picks (i.e. transverse of the warpwise direction), there being weft retainers projecting from the periphery of each of the wheels and the wheels being spaced apart laterally so that the two sets of weft retainers define the length of the weftspace.

17. A fabric producing machine as claimed in claim 16, in which the weft selvedge clamping means is provided in association with each weft store wheel.

18. A fabric producing machine as claimed in claim 17, in which the clamping means comprises an endless band carried by a pair of rollers spaced apart circumferentially of the weft store wheel in locations such that a tangent to the rollers forms a chord to the wheel and therefore the run of the endless band on the wheel side of the rollers is deformed from the said tangent by the periphery of the wheel to ensure tight engagement of the endless band with the periphery of the wheel.

19. A fabric producing machine as claimed in claim 18 in which the endless band is received in a groove in the periphery of the store wheel.

20. A fabric producing machine as claimed in claim 17, in which a selvedge slitter cooperates with the periphery of each store wheel on the inside of the weft retainers so that it will sever the weft loops formed around the weft retainers from the weft picks in the fell of the fabric.

21. A fabric producing machine comprising means for forming an array of weft yarns on a longitudinally moving weft store comprising two laterally spaced sets of weft retainers, in which there is a weft carrier mounted for lateral, weftwise, sliding motion on a beam and in which there is a cam-operated mechanism for moving the beam when the weft carrier is at the ends of its lateral motion in a warpwise direction through a distance greater than the longitudinal distance moved by the weft store during the longitudinal motion of the weft carrier.

22. A fabric producing machine as claimed in claim 21, in which the weft store is cylindrical so that the warpwise direction is arcuate and the beam is mounted on a cam-operated rocker turning about the longitudinal axis of the cylindrical weft store.

23. A method of manufacturing a fabric comprising: reciprocating a weft carrier laying a set of weft yarns in a lateral, weftwise, direction across a weftspace between two sets of weft retainers and moving said weft carrier in a longitudinal, warpwise, direction relatively to the weft retainers at at least one end of its weftspace traverse to lay the set of weft yarns across the weftspace at each lateral traverse, causing said weft carrier to hook each weft yarn around at least two weft retainers at at least one side of the weftspace, the relative warpwise movement between said weft carrier and said weft retainers being such that at each traverse of said weft carrier, after a first traverse, some, but not all, of the laid weft yarns are interdigitated with weft yarns previously laid by the weft carrier, the remaining weft yarns laid at that traverse being spaced from each other to permit a further set of weft yarns to be interdigitated with them on a subsequent traverse of the weft carrier.

24. A method of manufacturing a fabric comprising: feeding a substrate in a longitudinal warpwise direction reciprocating a weft carrier laying a set of weft yarns in a lateral, weftwise, direction across a weft space between two sets of weft retainers and moving said weft carrier in the longitudinal, warpwise, direction relatively to the weft retainers at at least one of its weft space traverse to lay the set of weft yarns across the weft space at each lateral traverse, causing said weft carrier to hook each weft yarn around at least two weft retainers at one side of the weft space, the relative warpwise movement between said weft carrier and said weft retainers being such that at each traverse of said weft carrier, after a first traverse, some, but not all, of the laid weft yarns are interdigitated with weft yarns previously laid by the weft carrier, or another weft carrier, on the same side of the substrate as the weft carrier, the remaining weft yarns laid at that traverse being spaced from each other to permit a further set of weft yarns to be interdigitated with them on a subsequent traverse of the or another weft carrier.

* * * * *